US005661916A

United States Patent [19]

Huang

[11] Patent Number: 5,661,916

[45] Date of Patent: Sep. 2, 1997

[54] ELECTRONIC STEP COUNTING SHOE

[76] Inventor: Tien-Tsai Huang, No. 4-2, Lane 30, Wu Chuan Street, Pan Chiao City, Taipei, Taiwan

[21] Appl. No.: 674,530

[22] Filed: Jul. 5, 1996

[51] Int. Cl.[6] ..... A43B 5/00; A43B 13/20

[52] U.S. Cl. ..... 36/132; 36/29; 73/172

[58] Field of Search ..... 36/1, 132, 136, 36/29; 128/779; 73/172, 714

[56] References Cited

U.S. PATENT DOCUMENTS

| | | | |
|---|---|---|---|
| 2,558,805 | 7/1951 | Yaglou | 73/172 |
| 3,791,375 | 2/1974 | Pfieffer | 128/779 |
| 4,402,147 | 9/1983 | Wu | 36/136 |
| 4,510,704 | 4/1985 | Johnson | 36/136 |
| 5,230,249 | 7/1993 | Sasaki et al. | 36/132 X |
| 5,373,651 | 12/1994 | Wood | 36/136 X |

*Primary Examiner*—Ted Kavanaugh
*Attorney, Agent, or Firm*—Fish & Richardson P.C.

[57] ABSTRACT

An electronic step counting shoe which includes a shoe body holding a fluid container, a pressure sensor, a temperature sensor, a circuit board, and a LCD, the circuit board having a pressure converter connected to the pressure sensor, a temperature compensating circuit connected to the temperature sensor, and a microprocessor, the pressure converter and the temperature compensating circuit converting pressure and temperature signals from the pressure sensor and the temperature sensor into corresponding electric signals for processing into corresponding digital signals by the microprocessor, permitting the digital signals thus obtained to be shown through the LCD through the control of a function switch.

9 Claims, 4 Drawing Sheets

ELECTRONIC STEP COUNTING SHOE

BACKGROUND OF THE INVENTION

The present invention relates to step counting shoes, and relates more particularly to such an electronic step counting shoe which measures the user's body weight and the number of steps the user exercises, and calculates the gross amount of calorie the user consumes.

When to measure the weight of the body, a weighing machine is needed. However, it is not convenient to carry a weighing machine with oneself for use whenever desired. Further, when to count the number of steps one exercises, a step counter may be required. If one forgets to carry a step counter, one cannot conveniently and accurately count the number of steps during an exercise. Regular step counters for this purpose are to be fastened to a part of the body when exercising. These step counters are commonly induced to count the number of steps by vibration, therefore they cannot accurately count the number of steps when the user walks at a slow speed.

When one is overweight, it means having too much fat. If one has too much fat, excessive calorie has been accumulated in the body. The best way to consume calorie is to take bodily exercise. According to medical reports, about 2.0 calories per hour will be consumed. When walking at the speed of 4 kms/hour; 3.4 calories per hour will be consumed when walking at the speed of 6.4 kms/hour about 9.3 calories per hour will be consumed when walking at the speed of 8.5 kms/hour. However, it is difficult to count the consumption of calorie when exercising.

SUMMARY OF THE INVENTION

The present invention has been accomplished under the circumstances in view. It is one object of the present invention to provide an electronic step counting shoe which automatically measures the user's body weight and the number of steps the user exercises, and compensates an error resulting from the change of temperature when it is used. It is another object of the present invention to provide an electronic step counting shoe which calculates the amount of calorie the user consumes subject to the product obtained by multiplying the body weight of the user by the number of steps the user exercises. According to the present invention, the electronic step counting shoe comprises a shoe body, a fluid container, a pressure sensor, a temperature sensor, a circuit board, and a LCD. The shoe body can be of any of a variety of forms for children, men, or ladies, and made of any of a variety of materials, having a camp and an outsole with a receiving chamber. The fluid container is mounted within the receiving chamber of the outsole, and filled up with a gas (for example air or nitrogen) or a liquid (for example, water), or silicone rubber. The outsole is reinforced with reinforcing ribs. The fluid container can have any of a variety of shapes defining a plurality of chambers communicating with one another. For example, the fluid container can be comprised of a front water chamber, a rear water chamber, and an intermediate water chamber communicating between the front water chamber and the rear water chamber. The fluid container further has an outlet. The outlet can be disposed at any desired location. The pressure sensor is disposed in contact with the fluid of the fluid container. For example, the pressure sensor can be installed in a connector fastened to the outlet of the fluid container. The connector has a pointed tip and a passage hole. When the connector is installed in the outlet of the fluid container, the pointed tip pierces the diaphragm of the outlet, permitting the fluid to flow from the fluid container through the passage hole into the inside of the connector so that the pressure sensor can detect the pressure of the fluid. The temperature sensor is mounted in the fluid container and disposed in contact with the fluid of the fluid container. As an example of the present invention, the temperature sensor can be mounted with the pressure sensor together to detect the temperature of the fluid of the fluid container. When the fluid floes in the fluid container, a temperature detecting error may occur. Therefore, a temperature compensating circuit means is needed to compensate such an error, so that a counting error can be eliminated. The circuit board is mounted within the receiving chamber of the fluid container, comprising a pressure converter, a temperature compensating circuit, and a microprocessor. The pressure converter is electrically connected to the pressure sensor, and adapted for converting the pressure signal detected by the pressure sensor into a corresponding electric signal and providing the electric signal thus obtained to the microprocessor for processing into a corresponding digital signal. The temperature compensating circuit is electrically connected to the temperature sensor, and adapted for converting the temperature signal detected by the temperature sensor into a corresponding electric signal and providing the electric signal thus obtained to the microprocessor for processing into a Corresponding digital signal, so as to provide a compensation for the error resulting from the change of the temperature of the fluid of the fluid container. The LCD is controlled to display the digital signals outputted from the microprocessor. The LCD is preferably mounted on the vamp of the shoe body at the front side. The microprocessor is electrically connected to a function switch, and has a display mode controlled by said function switch. The display mode of the microprocessor can be a number display mode adapted for driving the LCD to display the number of steps counted: by counting one each time the value calculated by said microprocessor surpasses a predetermined value and then drops below it. The display mode can also be a maximum weight display mode adapted for driving the liquid crystal display to display the maximum value currently obtained from the microprocessor. The display mode can also be a weight and number product display mode, the weight and number product display mode driving the liquid crystal display to display the product resulting from multiplying the weight and the number obtained from the circuit board through the microprocessor.

The electronic step mounting shoe can be designed for the left foot or the right foot. When to measure the body weight, the function switch is switched to the weight display mode. When the user stands up, the pressure of the body is loaded onto the fluid container, and the body weight is measured by the pressure sensor and shown through the LCD. When the function switch is switched to the number display mode, the LCD automatically shows the cumulated number of steps when the user walks. When the function switch is switched to the weight and step product display mode to show the product obtained from multiplying the detected pressure by the detected number of steps when to know the amount of calorie consumed, the function switch is switched to the calorie counting function mode.

DETAILED DESCRIPTION OF THE PREFERRED EMBODIMENT

Figure 1:
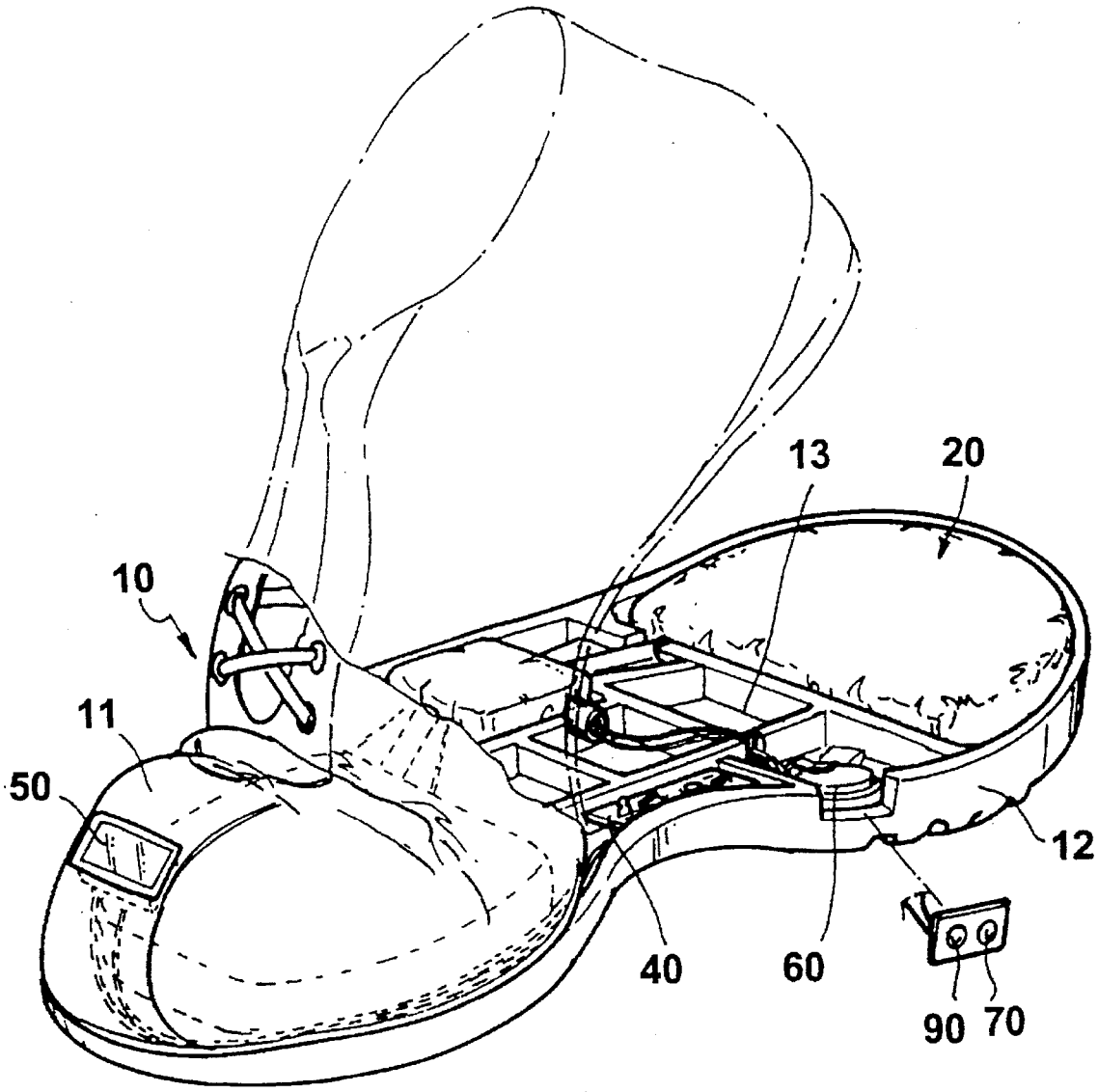
FIG. 1 shows the structure of an electronic step counting shoe according to the present invention.

Referring to FIG. 1, an electronic step counting shoe in accordance with the present invention is generally comprised of a shoe body 10, a fluid container 20, a pressure sensor 30 (see FIGS. 2A and 2B), a temperature sensor 35 (see FIG. 2B), a circuit board 40, a LCD (liquid crystal display) 50, an electric power source for example an electronic battery 60, a power switch 70, and a function switch 90. The shoe body 10 comprises a vamp 11, and an outsole 12. The LCD 50 is mounted on the vamp 11 at the front side. The fluid container 20, the circuit board 40, and the electronic battery 60 are mounted in a receiving chamber 13 defined within the outsole 12.

Figure 2B:
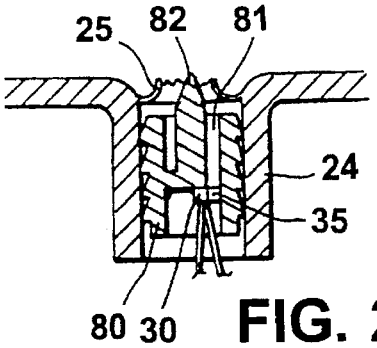
FIG. 2B is a sectional view in an enlarged scale of a part of FIG. 2A, showing the connector installed in the outlet of the intermediate water chamber.
Figure 2A:
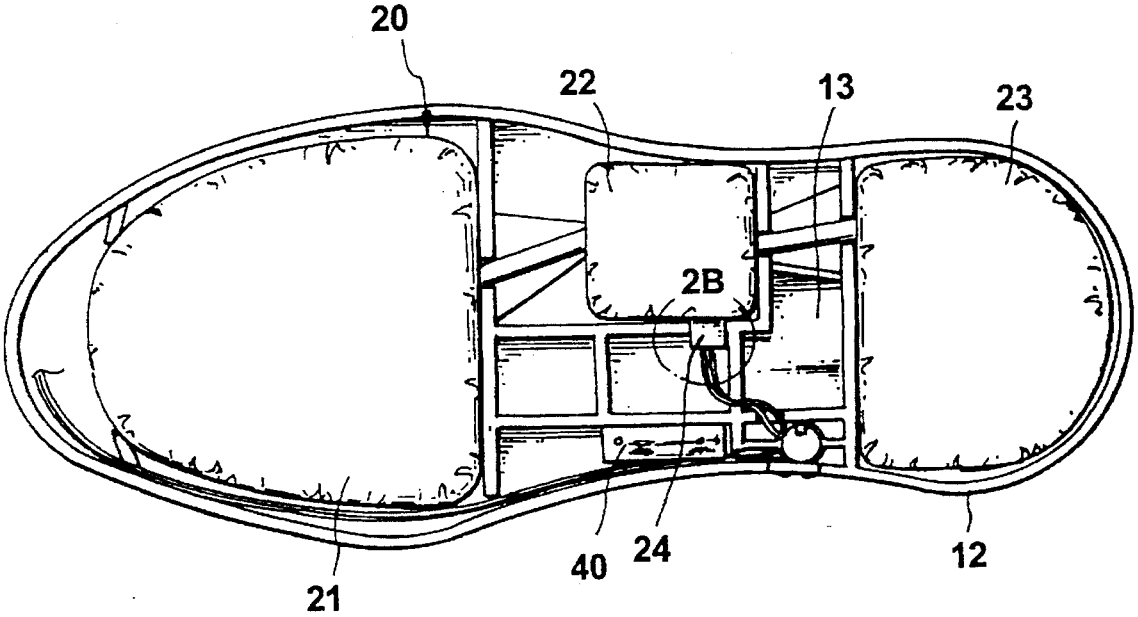
FIG. 2A is a top plain view of the electronic step counting shoe shown in FIG. 1.

Referring to FIG. 2A and 2B, the fluid container 20 comprises a front water chamber 21, a rear water chamber 23, and an intermediate wager chamber 22 communicating between the front water chamber 21 and the rear water chamber 23. The intermediate water chamber 22 has an outlet 24 sealed by a diaphragm 25. The pressure sensor 30 and the temperature sensor 35 are coupled to a connector 80. The connector 80 is adapted for fastening to the outlet 24 of the intermediate water chamber 22, having a passage hole 81 and a pointed tip 82 adjacent to the passage hole 81. When the connector 80 is fastened to the outlet 24 of the intermediate water chamber 22, the pointed tip 82 is forced to pierce the diaphragm 25, thereby causing the fluid to flow from the fluid container 20 to the pressure sensor 30 and the temperature sensor 35 through the outlet 24 and the passage hole 81.

The fluid container 20 is mounted in the receiving chamber 13 of the outsole 12. When the user wears the shoe and steps on the ground, the body pressure of the user is loaded onto the fluid container 20, therefore the pressure is detected by the pressure sensor 30. At the same time, the temperature of the fluid of the fluid container 20 is detected by the temperature sensor 35.

Figure 3:
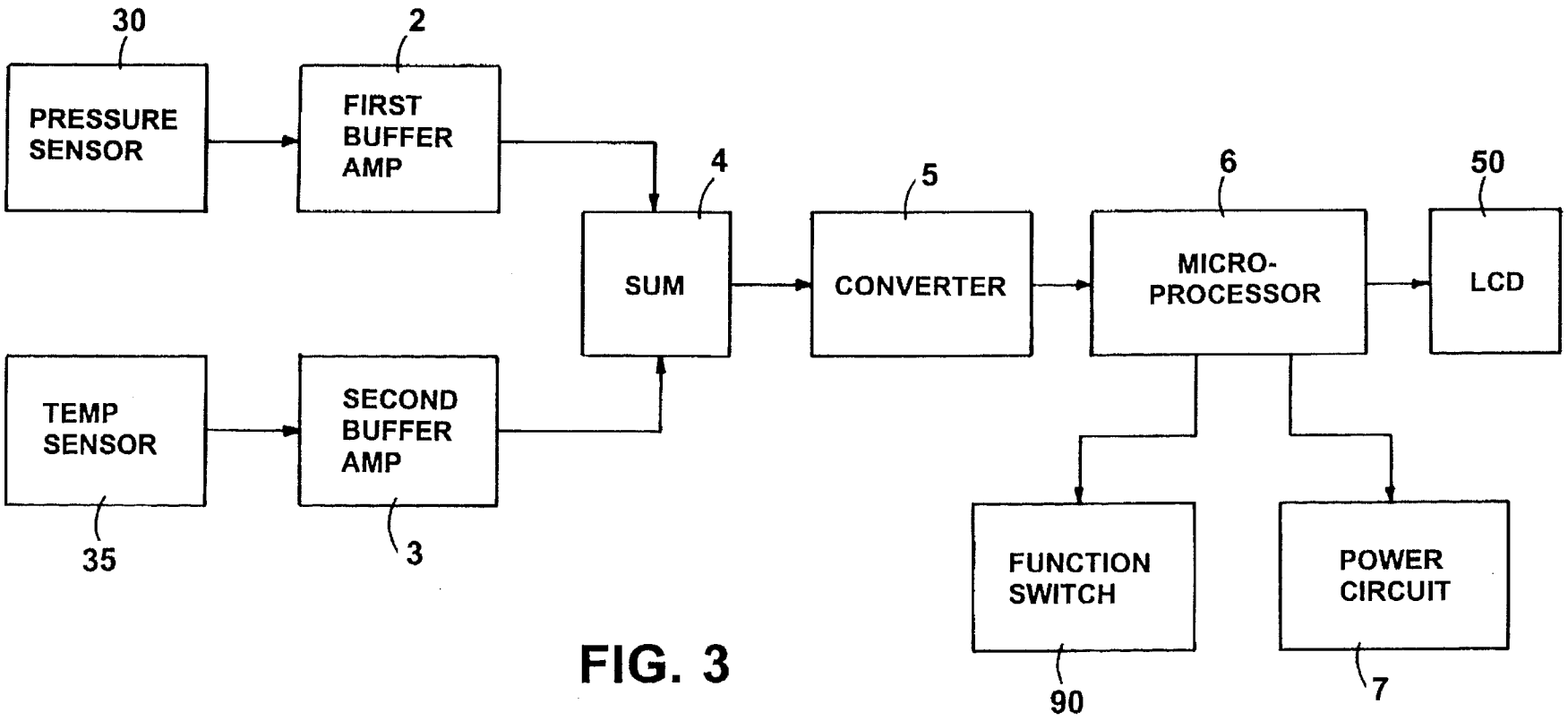
FIG. 3 is a circuit block diagram of the present invention.
Figure 4:
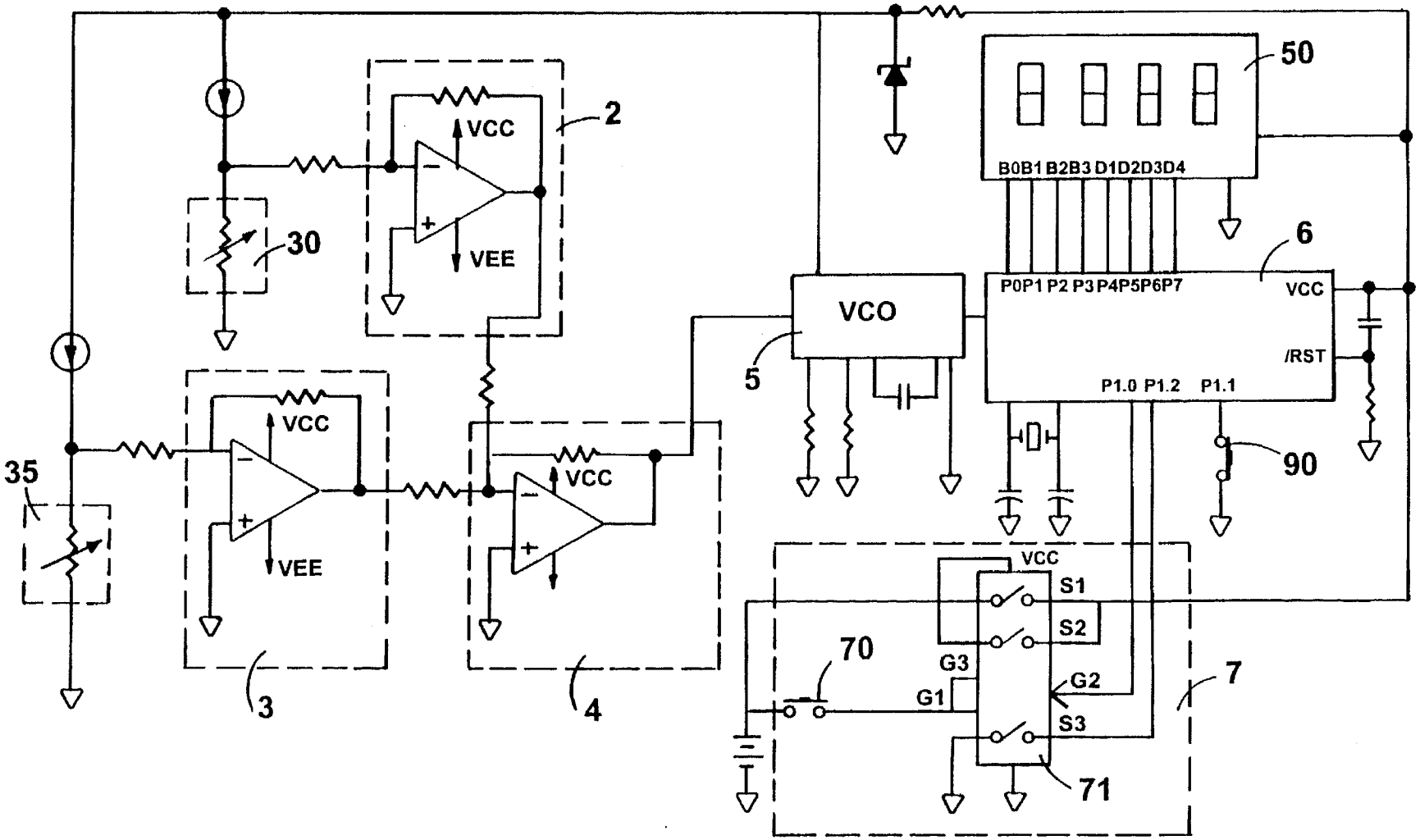
FIG. 4 is a circuit diagram of the present invention.

Referring to FIGS. 3 and 4, the pressure sensor 30 detects the pressure of the fluid of the fluid container 20, and sends a corresponding signal to a first buffer amplifier 2, causing it to provide a corresponding voltage signal output; the temperature sensor 35 detects the temperature of the fluid of the fluid container 20, and sends a corresponding signal to a second buffer amplifier 3, causing it to provide a corresponding voltage signal output. The voltage signals outputted from the buffer amplifiers 2,3 are respectively sent to a sum 4 for processing, causing it to provide a respective voltage (or current) signal output. The voltage signal outputted from the sum 4 is then converted into a corresponding frequency signal by a voltage/frequency (or current/frequency) converter 5 (which comprises a voltage control oscillator). The frequency signal outputted from the converter 5 is then sent to a microprocessor 6 for processing. The result is then sent from the microprocessor 6 to the LCD 50 for display. The microprocessor 6 is controlled by the function switch 90 to show different data through the LCD 50 (this will be described further).

The power circuit, referenced by 7, is connected to the microprocessor 6, comprised of a press-button type power switch 70 and a linear switch 71. When the press-button type power switch 70 is pressed on, the linear switch 71 is connected to the power terminal of the microprocessor 6, causing it to start the system. When the system is started, G2 which carries signal to the linear switch immediately locks power supply. When the present button type power switch 70 is pressed again, G2 signal is cut off, and therefore power supply is turned off.

The function switch 90 is connected to the microprocessor 6 and adapted for switching different functions for execution by the setting of the software built in the microprocessor 61. These functions are outlined hereinafter.

1. WEIGHT DISPLAY: Under this function mode, the microprocessor 6 automatically displays the weight measured once per 0.3–0.8 second.
2. MAXIMUM WEIGHT DISPLAY: Under this function mode, the microprocessor 6 displays the maximum value of the weight measured, and the value displayed will be replaced only when a bigger value is measured. The maximum value will be reset when trip off.
3. NUMBER DISPLAY: The microprocessor 6 has a default, and will add one to the number displayed when the weight surpasses the default and then drops below it, i.e., the weight measured surpasses the default when the user steps the shoe on the ground while running (or walking), or drops below the default when the user lifts the shoe from the ground, and therefore the microprocessor 6 adds one to the number displayed when the user steps one step.
4. WEIGHT AND STEP PRODUCT DISPLAY: Under this function mode, the microprocessor 6 displays the product, which results from multiplying the weight by the number of steps, and the value of calorie, which results from multiplying the product thus obtained by a constant.

As indicated, when the user wears a pair of electronic step counting shoes made according to the present invention and takes an exercise, the shoes automatically measure the body weight of the user, count the number of steps the user exercises, and show the total calorie currently consumed.

While only one embodiment of the present invention has been shown and described, it will be understood that various modifications and changes could be made without departing from the spirit and scope of the invention disclosed.

What the invention claimed is:

1. An electronic step counting shoe comprising:

a shoe body having a vamp and an outsole and a receiving chamber defined within said outsole;

a fluid container mounted in the receiving chamber of the outsole of said shoe body and filled up with a fluid;

a pressure sensor disposed in contact with the fluid of said fluid container and adapted for detecting the pressure of the fluid;

a temperature sensor disposed in contact with the fluid of said fluid container and adapted for detecting the temperature of the fluid;

a circuit board mounted in the receiving chamber of said shoe body, said circuit board comprising a pressure converter, a temperature compensating circuit, and a microprocessor, said pressure converter being electrically connected to said pressure sensor, and adapted for converting the pressure signal detected by said pressure sensor into a corresponding electric signal and providing the electric signal thus obtained to said microprocessor for processing into a corresponding digital signal, said temperature compensating circuit being electrically connected to said temperature sensor, and adapted for converting the temperature signal detected by said temperature sensor into a corresponding electric signal and providing the electric signal thus obtained to said microprocessor for processing into a corresponding digital signal, so as to provide a compensation for the error resulting from the change of the temperature of the fluid of said fluid container; and a liquid crystal display electrically connected to said microprocessor and adapted for displaying the digital signals outputted from said microprocessor.

2. The electronic step counting shoe of claim 1 wherein said liquid crystal display is mounted on the vamp of said shoe body.

3. The electronic step counting shoe of claim 1 wherein said fluid container has an outlet sealed with a diaphragm; said pressure sensor and said temperature sensor have a respective detecting end respectively coupled to a connector mounted in the outlet of said fluid container, said connector having a pointed tip piercing said diaphragm and a passage hole adapted for guiding the fluid of said fluid container to the detecting ends of said pressure sensor and said temperature sensor.

4. The electronic step counting shoe of claim 1 wherein said microprocessor is electrically connected to a function switch, and has a display mode controlled by said function switch.

5. The electronic step counting shoe of claim 4 wherein said display mode is a number display mode adapted for counting, permitting the counted number to be shown through said liquid crystal display, said counting display mode counting one each time the value calculated by said microprocessor surpasses a predetermined value and then drops below it.

6. The electronic step counting shoe of claim 4 wherein said display mode is a maximum weight display mode adapted for driving said liquid crystal display to display the maximum value currently obtained from said microprocessor.

7. The electronic step counting shoe of claim 4 wherein said display mode is a weight and number product display mode, said weight and number product display mode driving said liquid crystal display to display the product resulting from multiplying the weight and the number obtained from said circuit board through said microprocessor.

8. The electronic step counting shoe of claim 1 wherein said liquid container comprises a front water chamber, a rear water chamber, and an intermediate water chamber communicating between said front water chamber and said rear water chamber.

9. The electronic step counting shoe of claim 8 wherein said outlet of said liquid container is disposed in said intermediate water chamber.

* * * * *